United States Patent [19]

Kaiser

[11] 4,183,205

[45] Jan. 15, 1980

[54] COIN OPERATED PARKING METER

[75] Inventor: Bernhard Kaiser, Villingen-Schwenningen, Fed. Rep. of Germany

[73] Assignee: Kienzle Apparate GmbH, Villingen, Fed. Rep. of Germany

[21] Appl. No.: 948,474

[22] Filed: Oct. 4, 1978

[30] Foreign Application Priority Data

Oct. 8, 1977 [DE] Fed. Rep. of Germany ..... 2745471

[51] Int. Cl.[2] ..... G07C 1/30

[52] U.S. Cl. ..... 58/142; 194/DIG. 21

[58] Field of Search ..... 58/141-143; 194/DIG. 20, DIG. 21

[56] References Cited

U.S. PATENT DOCUMENTS 2,623,933 12/1952 Allstadt, Jr. ..... 194/DIG. 21

2,652,551 9/1953 Gumdertz et al. ..... 58/142

*Primary Examiner*—Edith S. Jackmon

*Attorney, Agent, or Firm*—Toren, McGeady and Stanger

[57] ABSTRACT

An arrangement for resetting a coin operated parking meter is disclosed. By the use of a sensor to monitor a parking space, it can be determined when a vehicle leaves the parking space with parking time remaining. A resetting device within the meter clears the meter of remaining parking time. The resetting device includes an electric motor, a cam disk affixed to the motor shaft and a coupling member arranged between the cam disk and time indicating portion of the meter. The coupling member returns an indicator of the time indicating portion to a defined initial angle position. The resetting device is responsive to an electrical signal received from the sensor.

9 Claims, 3 Drawing Figures

COIN OPERATED PARKING METER

FIELD OF THE INVENTION

The invention relates to a coin operated parking meter for automatically setting parking time by inserting one or several coins having a clockwork for measuring the parking time set and having a resetting device for clearing the remaining parking time when the vehicle prematurely leaves the parking space operated by sensing means indicating the "occupied" or "unoccupied" state of the parking space.

BACKGROUND OF THE INVENTION

Various embodiments of coin operated parking meters are known in which the insertion of a coin will cause a time interval corresponding to the value of the coin to be indicated by setting indicator means with respect to a scale. Generally, parking meters consist of a coin transport and testing device, a parking time setting device for setting the parking time on the indicating means and of a clockwork which returns the indicator means in accordance with the time to the initial or zero position.

The coin transport and testing device guides a coin through several testing zones and gives one or several criterion as to whether the coin is usable so that a corresponding time may be set at the time indicator means. When the indicating means has been set to a corresponding parking time, a clockwork is started and, via a clutch device, the indicator means is driven within the indicating unit contrary to the setting direction to its initial position. Normally, the clockworks are mechanical driving means having a clock spring as an accumulator and a governor for governing the time-correct return of the indicator means. Such a parking meter is used in describing the subject of the present invention. However, other driving systems for governing the time-correct resetting of the indicator means may be used such as, for instance, synchronous motors, step switch motors and the like, which may also be used in applying the subject of the present invention.

All such parking meters are disadvantageous insofar as their indicator means may not be returned to a zero position before the predetermined time interval has expired. From experience with parking meters, it is known that the time set up by inserting one coin is very often only partially used by the car owner, sometimes it is only used up for a very short time. The remaining parking time on this parking space which has been made available to the user can be used up by the following user without the latter having paid with a coin for this time. Apart from the fact that the remaining parking time has already been paid for by the foregoing user, the following user exceeds the prescribed time limit for this parking space as, in addition to the maximum parking time available to him, he may also use up the parking time of his predecessor.

Apart from controlling the use of the available parking space, parking meters have also the object of making corresponding resources available to the communities which have to maintain the parking spaces at their own cost. It is therefore quite apparent that the revenues will be greatly increased when, each time a parking space becomes available by a vehicle leaving it, the parking meter is immediately returned to the zero indicating position. This means that the use of the remaining parking time and of time exceeding the maximum parking time is avoided. Each driver is obliged to pay the usual parking fee for occupying a corresponding parking space.

To achieve a resetting of the remaining parking times, parking meters have become known which cooperate with mechanical (U.S. Pat. No. 3,034,287) or pneumatic (U.S. Pat. Nos. 3,015,208, 3,054,251 & 3,064,416) devices when a vehicle wheel cooperates therewith.

In U.S. Pat. No. 3,034,287, a device is shown in which a movable threshold is arranged in the track of a vehicle wheel, which, due to the load, is lowered against the pressure of a spring. The threshold is in mechanical connection with the adjusting means for the time indicator via a rope or chain driving means so that, under load, the traction of the rope is loosened and a spring released by the insertion of a coin can move the indicator means to a predetermined time setting. On the other hand, when the vehicle wheel is removed from the threshold, the spring moves the threshold to the initial position, thereby retensioning the rope which moves the indicator means via a toothed wheel to the zero indicating position. To allow for this, the driving engagement between the clockwork and the time indicator is disengaged. A device of this kind means that at the place of installation, considerable measures have to be taken. Further, a permanent service has to be maintained with respect to adjusting the mechanical connecting elements.

With the devices in accordance with U.S. Pat. Nos. 3,015,208, 3,054,251 and 3,064,416, compressed air chambers are arranged in the parking space which are influenced from a vehicle wheel. Such chambers are connected via a pressure pipe with a pressure cylinder containing a movable piston within the parking meter. When a vehicle wheel on leaving the parking space moves over the elastic compressed air chamber, the air moves the piston in the cylinder and thereby via a leverage, moves an arrangement of pawls out of engagement (U.S. Pat. No. 3,015,208) so that the indicator device is unclutched and is resettable under spring action to the zero indicating position. In like manner, by means of a compressed air pulse from the elastic compressed air chamber as delivered by the vehicle wheel in the parking space, the devices in accordance with U.S. Pat. Nos. 3,054,251 and 2,064,416 release pawl and ratchet arrangements or similar clutch devices in order to unclutch the indicator means from the normal clockwork driving means. Accordingly, by means of the main driving spring of the clockwork, the indicators are quickly returned to the basic position. Also, for the last mentioned devices, constructive arrangements have to be taken at the building site which appear to be highly uneconomical especially in cases of subsequent equipment with such devices.

Apart from the mechanically or pneumatically operating devices for deleting the remaining parking times, electromechanical arrangements have also become known for parking meters. Detector means in the parking space recognize the pressence or absence of a vehicle and produce a signal which is suited to return the indicating means to zero position. As a detector means for supervising the parking space, proximity switches on the basis of changes in a magnetic field (U.S. Pat. No. 3,018,615), infrared generators, photoelectric cells, supersonic wave generators (U.S. Pat. No. 3,535,870) and others may be used as sensor elements supervising the parking space.

For instance, from U.S. Pat. No. 3,535,870, a device has become known for clearing the remaining parking time. For use as a sensor means within the parking space, a supersonic wave generator and a receiver are provided which generate pulses of a certain frequency. As long as the receiver regularly receives signals, that is, as long as the vehicle is in the parking space, this indicates that, for the internal control of the parking meter, the parking space is occupied. As soon as there are no signals returned, this signifies that the parking space has been cleared. When no return signals are received, an electronic circuit arrangement delivers a voltage to a corresponding magnet which pivots parts of the gearing means out of engagement with each other so that the clockwork driving means is disengaged between the main driving spring and the speed governor. The force of the spring then drives the time indicator back to the zero indicating position where a switch is opened so that the magnet is cut off. This arrangement is very expensive, especially with a view to the electronic circuitry,and may not be easily integrated into already existing equipment. Returning the indicator means is an additional load on the spring driving means.

In another known device in accordance with U.S. Pat. No. 2,652,551, the movable indicator means which indicates the parking time paid for on a scale is unrotatably connected to a shaft and is connected via a toothed wheel gearing and a friction clutch with a clockwork mechanism. Via a crank arm, an electromagnet is also connected to the time indicator shaft and when the electromagnetic coil is under current, the time indicator means is returned to the zero indicating position. The resetting movement of the indicator is possible when the force of the magnet is sufficient to overcome the frictional moment of the clutch since, between the indicator and the actual clockwork, there is the above-mentioned friction clutch. Between the sensor means in the parking space and the control circuit for the electromagnet, there is a great deal of electronic circuitry for amplifying and shaping the signals which are finally sent to a relay in the energizing circuit for the electromagnet. It is rather disadvantageous that such electromagnets use relatively high currents to produce a rather small movement in order to produce the necessary force. This means that there is no safeguard that the resetting to the zero indicating position by means of magnetic forces is safely accomplished.

SUMMARY OF THE INVENTION

It is the object of the invention to design an additional device of a most simple construction for the coin operated parking meters of the conventional design so that, by means of sensor means for the parking space, it is possible to clear remaining parking time on a correspondingly arranged parking meter immediately upon removing the vehicle from the corresponding parking space.

This object is achieved by implementing the parking meter by a resetting device comprising an electromotor controlled by a cam disk on the motor shaft, the motor circuit being operated by a pulse from a sensing means arranged in the parking space, the cam disk also driving a coupling member arranged between the resetting device and time indicator means, which coupling member is provided with a guide slot at one end thereof for returning the indicator means to a definite initial angular position from each indicating position.

The resetting device according to the invention may be incorporated in every parking meter without changing the basic constructional design of the known parking meters. Since there is a frictional clutch between the clockwork driving means and the setting means on one hand and the indicator means on the other hand, the indicators may be returned to the initial position from each other positioned by the resetting driving means. The resetting driving means serve exclusively to return the indicator means and are completely independent of the time driving and time setting driving means. Therefore, it does not require any torque from the driving means (for instance, from the spring barrel). That means that by the separate resetting driving means as proposed for clearing the remaining parking time simultaneously, the stored forces for the normal operation of the parking meters in a conventional parking meter are increased. The general servicing of the parking meter, especially the winding of the clockwork spring, may be extended over longer time intervals. Because the very simple coupling element between the zero setting driving means and the indicator means, there is continuous connection between the two parts so that it is not necessary to bring any parts of the gearing into and out of engagement. The cam disk arranged on the motor shaft makes sure that once the resetting has been released, it is definitely terminated since the current supply to the motor is controlled by itself. Since the cam disk is simultaneously the control element for the electric circuitry and the driving element for the coupling member, this part fulfills two functions due to its shape.

For a better understanding of the present invention together with other and further objects thereof, reference is made to the following description and accompanying drawings, while the scope of the invention will be pointed out in the appended claims.

BRIEF DESCRIPTION OF THE DRAWINGS

Referring to the drawings.

DESCRIPTION OF THE PREFERRED EMBODIMENTS

Figure 1:
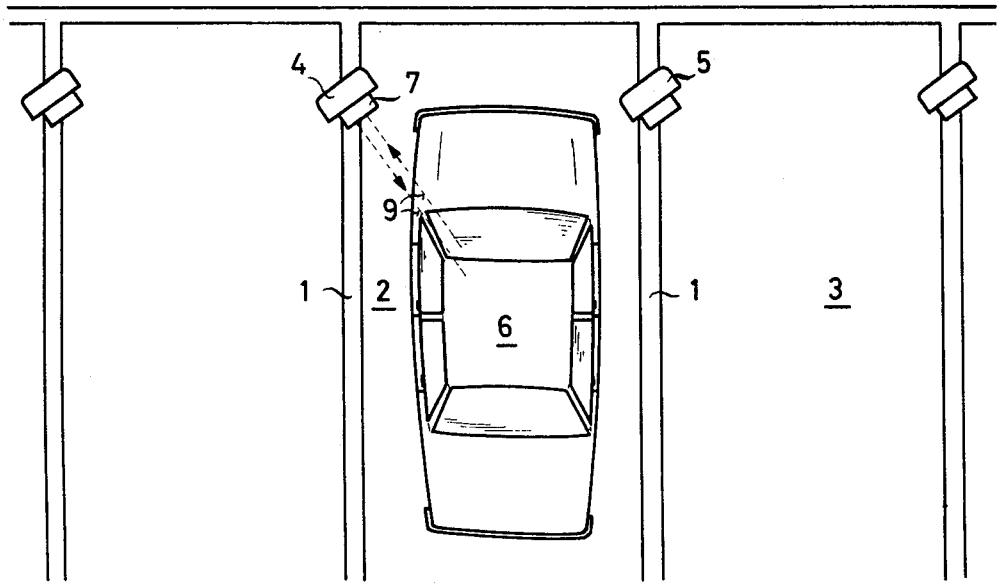
FIG. 1 is a top view of a parking space with parking meters and a parking space monitoring device.

Parking spaces for vehicles especially in parking areas of parking houses are generally divided by markings 1 into individual parking spots 2, 3 as shown in FIG. 1. At each parking spots 2, 3, there are arranged in suitable position, so that they may not be overlooked by the drivers, coin operated parking meters of known construction. In accordance with the regulations, one or several coins have to be introduced into the parking meter in order to have parking permitted for a maximum parking time corresponding to the local regulations. Each user of a parking space will therefore introduce a sufficient quantity of coins for a predetermined parking parking time or he will return in good time in order to avoid any fines. For the high percentage of parking meters 4, 5, it can be said from experience that the parking spaces 2, 3 are prematurely cleared so that the remaining parking time can be used up by the following user without the newcomer having to pay the fee for using the parking space 2, 3 for the remaining time.

For reasons of fairness, it is therefore quite reasonable that each user should have to pay a fee when he leaves his vehicle on a particular parking space. Also, experience shows that by using remaining parking times, the communities lose considerable revenues. Conversely, when using a system for clearing the remaining parking time, it is observed that the income is increased.

For monitoring the parking space by clearing the remaining parking time after the parking space 2 has been cleared by the vehicle 6, the parking meter 4 arranged on this parking space 2 is provided with a sensor means 7 monitoring this parking space. The sensor means 7 is regularly a separate unit of the actual parking meter 4 and is arranged in a special housing 8 (FIG. 2) fastened in known manner, for instance, at the support for the parking meter 4. The sensor means may be a known infrared generator, a supersonic generator and receiver, or a loop detector, a light barrier or any other generator which is in a position to recognize the absense or presence of a vehicle 6 in the sensing path thereof. An example of a sensor means which may be used in this application is shown in the aforementioned U.S. Pat. Nos. 3,018,615 and 3,535,870. It is advantageous to arrange a sensing means within the parking space so that its sensing path penetrates the parking space diagonally.

Figure 2:
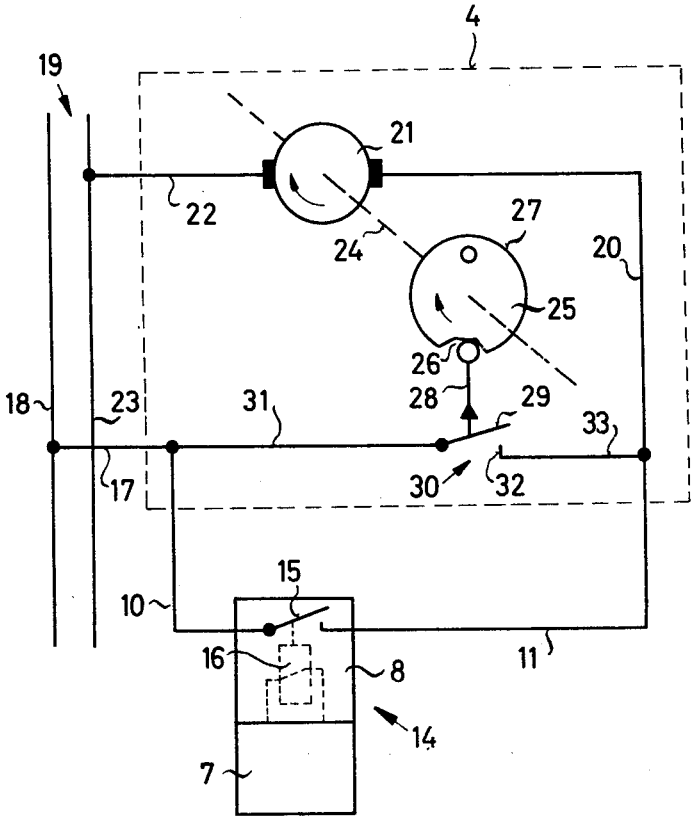
FIG. 2 is a circuit for controlling the resetting of the indicator means by an electromotor release by the monitoring device for the parking space.

Referring to FIG. 2, a signal or a pulse resulting from the sensing means is delivered via leads 10 and 11 to the electromotor resetting device 13 within the appropriate parking meter 4. The sensing means shall be designated generator 14 irrespective of its functional design, and in FIG. 2, it is diagrammatically represented as a make-switch 15 which is brought to its closed position by a relay 16.

The sensing means 7 in accordance with the embodiment is preferably of such design that the switch 15 is only closed shortly after the vehicle 6 has been moved out of the sensing path 9. A closing time or pulse duration of two to four seconds for the switch 15 or, generally termed, the generator 14, is sufficient in order to set into motion the resetting device 13. As may be seen from the circuit diagram in accordance with FIG. 2, which circuit serves to control the resetting device 13, a lead 17 is connected to one phase 18 of the voltage source 19, with a lead 10 being connected to the switch 15. The other side of the switch 15 is connected via leads 11 and 20 to a motor 21, and, following the motor, by way of a lead 22 to the second phase 23 of the voltage source 19.

Connected to the shaft 24 of the motor 21, there is a cam disk 25 having a segment-shaped cut-out 26. The periphery 27 and the cut-out 26 of the cam disk 25 serve to actuate a movable contact arm 29 of a make and brake switch 30 via a connecting rod or lever 28. The switch 30 via a lead 31 and the lead 17 are connected to the phase 18 of the voltage source 19 while the contact 32 connects the motor circuit to the second phase 23 of the voltage source 19 via a lead 33 and the parts 20, 21, 22. To connect the motor 21 to the voltage source 19, there is a first branch circuit having parts 17, 10, 15, 11, 20 and in parallel thereto a second circuit branch 17, 31, 30 (29, 32), 33, 20.

When the vehicle 3 is removed from the parking space, the generator 14 and the switch 15 are closed for a short time so that the motor 21 is connected to the voltage source driving the shaft 24 with the cam disk 25 in clockwise direction according to FIGS. 2 and 4. Immediately after the motor 21 has started, the cam disk 25 operates the switch 30 and connects the motor 21 to the second branch circuit 31, 30, 33 of the voltage source 19. Since the cam disk 25 has only a cut-out 26 at its circumference, the cam disk keeps the motor circuit closed after having been released for one revolution via the first circuit branch 10, 15, 11 so that it makes exactly one revolution. It is only necessary that the switch 15 remains closed until, by way of a certain angular motion of the cam disk 25, the switch 30 and thereby the motor circuit has been connected to the second circuit branch 31, 30, 33. After having completed one revolution, the connecting lever 28 driven by a spring can enter into the cut-out 26 of the cam disk 25. When the switch 30 is open, the motor 21 is de-energized.

Figure 3:
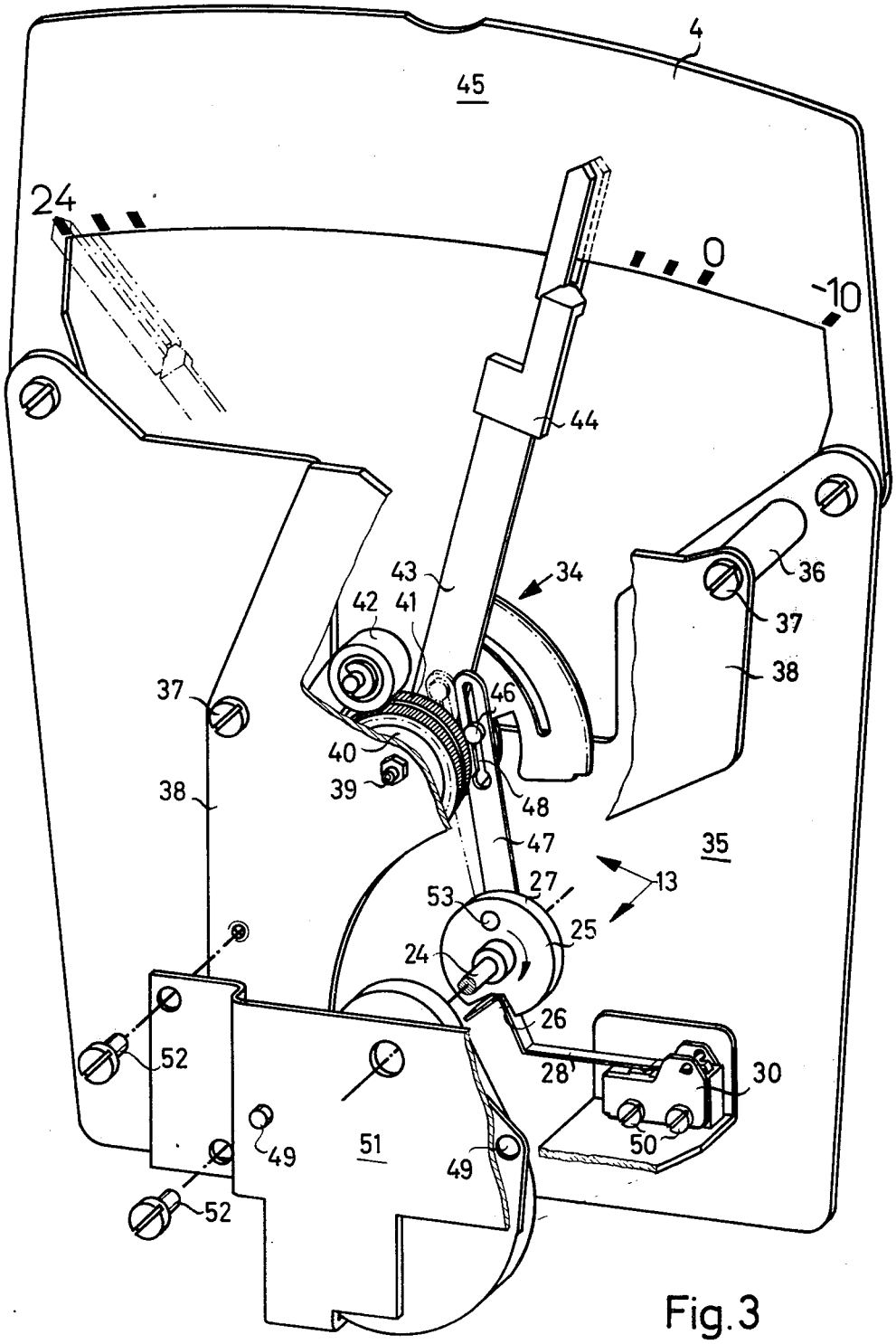
FIG. 3 is a view of the driving means for resetting the indicator means.

FIG. 3 shows a practical example of a resetting device 13 with electromotor in connection with the indicator means 34 of a conventional parking meter 4. Between the bearing plates 35 and 38 which are connected to each other by means of screws 37 and spacing pieces 36, the indicator means 34 are rotatably mounted on a shaft 39. To allow a better observation, the plate 38 has been partially cut away to show toothed wheels 40 and 41 which may be brought into driving connection by means of a friction clutch in the form of a spring actuated rubber roller 42. The front toothed wheel 40 in accordance with FIG. 3 is in driving connection with a clockwork (not shown) for returning the time indicator means 34 from its actual indicating position to the zero position in accordance with the tariff. The backward toothed wheel 41 is coaxially and rotatably arranged on the shaft 39 but fixed to a part 43 of the time indicator means 34. In accordance with the position of the time indicator means 34, a two-armed lever 44 cooperates with a scale 45 printed on two sides to indicate the remaining parking time.

At the indicator element 43, there is fastened a catch 46 cooperating with a coupling member 47 and a guide slot 48 therein. The coupling member 47 is the only gearing connection between the resetting device 13 and the time indicator means 34. It is rotatably mounted on a bolt 53 on the cam disk 25. In accordance with the cinematic principles of a crank driving means, the radius for arranging the bolt 53 on the cam disk 25 has to be chosen so that, when the cam disk 25 rotates, the part of the gearing to be looked upon as the hink (lever system 39, 43, 46) of the indicator element 43 covers a distance that is at least as large as that maximally required in angular movement to return the indicator element 43 to the zero indicating position.

Of course, it would be useful to design the cam disk 25 in such manner that the resetting movement is slightly larger than required and to make the guide slot 48 correspondingly longer. In this manner, for instance, the exact return movement of the indicator element 43 to the initial position may be adjusted by adjusting the cam disk 25 on shaft 24. All parts of the resetting device 13, that is, the motor 21, the cam disk 25 and the switch 30 are connected by means of screw connections 49, 50 to a bracket 51. The bracket 51 is connected via screws 52 to the plate 38 of parking meter 4.

The switch 30 is longitudinally adjustable (which feature is not specifically shown) in order to be able to vary the angular position of the cut-out 26 at the cam disk 25 and thereby vary also the switching point of the switch 30. Since the cam disk 25 is adjustably mounted on the shaft 24 and since, also, the switch 30 may be adjustable with respect to the bracket 51, the resetting distance for the time indicator means 43 may be fixed in accordance with the de-energizing point for the motor when the zero indicator position has been reached. The whole resetting device 13 is separately mountable and can easily be inserted in already known parking meter systems as a separately mountable resetting unit.

While the foregoing description and drawings represent the preferred embodiments of the present invention, it will be obvious to those skilled in the art that various changes and modifications may be made therein without departing from the true spirit and scope of the present invention.

What is claimed is:

1. In a coin operated parking meter arrangement for automatically setting a parking time by inserting at least one coin, said meter having a clockwork and time indicating portion including an indicator and adapted to being reset upon a vehicle prematurely leaving a parking space, the improvement comprising:

sensing means for sensing the parking space with respect to its occupied state and providing an electrical signal as an output thereof; and means responsive to said sensing means for resetting said meter to clear available parking time, said resetting means including:

an electric motor having a shaft, a cam disk fastened to the shaft of said motor, a coupling member arranged between said cam disk and said time indicating portion for returning the indicator of said indicating portion from an indicating position to a defined initial angle position, and means responsive to said electrical signal for applying power to said motor for driving the coupling member to return the indicator to the defined initial angle position.

2. The coin operated parking meter arrangement according to claim 1, wherein said coupling member includes a guide slot and said time indicating portion includes a catch which cooperates with said guide slot.

3. The coin operated parking meter arrangement according to claim 1, wherein said electrical signal from said sensor is a pulsed signal of sufficient duration to enable said power applying means to cause said motor to rotate.

4. The coin operated parking meter arrangement according to claim 3, including a separate circuit for maintaining electrical power flow to said motor through a full revolution of said cam disk.

5. The coin operated parking meter arrangement according to claim 4, wherein said cam disk actuates said separate circuit.

6. The coin operated parking meter arrangement according to claim 4, including a switch element responsive to movement of said cam disk.

7. The coin operated parking meter according to claim 6, wherein said cam disk includes a cut-out and wherein a connecting lever is disposed between said switch and said cam disk, said connecting lever including a member which cooperates with said cut-out.

8. The coin operating parking meter according to claim 6, wherein the arrangement of cam disk and switch includes means for adjusting the relative position of one with respect to the other so as to define the initial position of said indicator and, as a consequence, the switching off of power to the motor.

9. The coin operated parking meter according to claim 8, wherein said adjusting means includes a movable bracket for supporting said switch.

* * * * *